United States Patent [19]

Ura et al.

[11] Patent Number: 4,712,532

[45] Date of Patent: Dec. 15, 1987

[54] CRANKCASE EMISSION CONTROL SYSTEM FOR AN INTERNAL COMBUSTION ENGINE

[75] Inventors: Syouzabu Ura, Fujisawa; Makoto Yasuda; Yoshitaka Ooki, both of Yokohama, all of Japan

[73] Assignee: Nissan Motor Company, Limited, Japan

[21] Appl. No.: 920,439

[22] Filed: Oct. 20, 1986

[30] Foreign Application Priority Data

Oct. 21, 1985 [JP] Japan ..... 60-160963[U]

[51] Int. Cl.[4] ..... F02B 25/02

[52] U.S. Cl. ..... 123/572

[58] Field of Search ..... 123/572–574, 123/41, 86

[56] References Cited

U.S. PATENT DOCUMENTS

| | | | |
|---|---|---|---|
| 3,661,128 | 5/1972 | Eshelman | 123/574 |
| 4,269,607 | 5/1981 | Walker | 123/573 |
| 4,541,399 | 9/1985 | Tanaka et al. | 123/573 |
| 4,603,673 | 8/1986 | Hiraoka et al. | 123/572 |
| 4,656,991 | 4/1987 | Fukuo et al. | 123/572 |

*Primary Examiner*—William A. Cuchlinski, Jr.

*Attorney, Agent, or Firm*—Leydig, Voit & Mayer

[57] ABSTRACT

An air intake passage leads to a combustion chamber. A throttle valve is disposed in the air intake passage. A first gas passage connects a crank chamber to a point of the air intake passage downstream of the throttle valve. A control valve is disposed in the first gas passage. A second gas passage connects the crank chamber to a point of the air intake passage upstream of the throttle valve. A communication passage connects the second gas passage to a point of the first gas passage between the control valve and the crank chamber.

6 Claims, 4 Drawing Figures

CRANKCASE EMISSION CONTROL SYSTEM FOR AN INTERNAL COMBUSTION ENGINE

BACKGROUND OF THE INVENTION

1. Field of the invention

This invention relates to a crankcase emission control system or a crankcase ventilation system for an internal combustion engine, such as a V-type internal combustion engine.

2. Description of the Prior Art

In internal combustion engines, compressed air-fuel mixture and combustion products leak from combustion chambers into a crankcase past piston rings. This leakage is called "blow-by gas". Since blow-by gases contain harmful components, it is necessary to prevent them from venting to the atmosphere.

A crankcase emission control system or a crankcase ventilation system returns blow-by gases back to combustion chambers in order to prevent their emission into the atmosphere.

U.S. Pat. No. 3,661,128 discloses a crankcase ventilation system for a V-type internal combustion engine. This system includes passages which return blow-by gas from a crankcase to combustion chambers. Since peak pressures within the combustion chambers increase with the engine load, the rate of the gas leakage into the crankcase also increases with the engine load. In this system, the sum of the effective cross-sectional areas of the blow-by gas return passages is generally limited to a relatively small value, so that the speeds of the blow-by gas flows in the return passages are relatively high at heavy engine loads. The crankcase also defines a reservoir of engine lubricating oil. As the speeds of the blow-by gas flows in the return passages increase, the rate of lubricating oil undesirably entrained or carried by these gas flows from the crankcase to the combustion chambers increases. Accordingly, in this system, the engine lubricating oil is dissipated or wasted at a relatively high rate when the engine load is heavy.

SUMMARY OF THE INVENTION

It is an object of this invention to provide a crankcase emission control system for an internal combustion engine, such as a V-type internal combustion engine, which enables an acceptable rate of dissipation of engine lubricating oil even when the engine load is heavy.

According to a crankcase emission control system of this invention, an air intake passage leads to a combustion chamer. A throttle valve is disposed in the air intake passage. A first gas passage connects a crank chamber to a point of the air intake passage downstream of the throttle valve. A control valve is disposed in the first gas passage. A second gas passage connects the crank chamber to a point of the air intake passage upstream of the throttle valve. A communication passage connects the second gas passage to a point of the first gas passage between the control valve and the crank chamber.

DESCRIPTION OF THE PREFERRED EMBODIMENT

Figure 1:
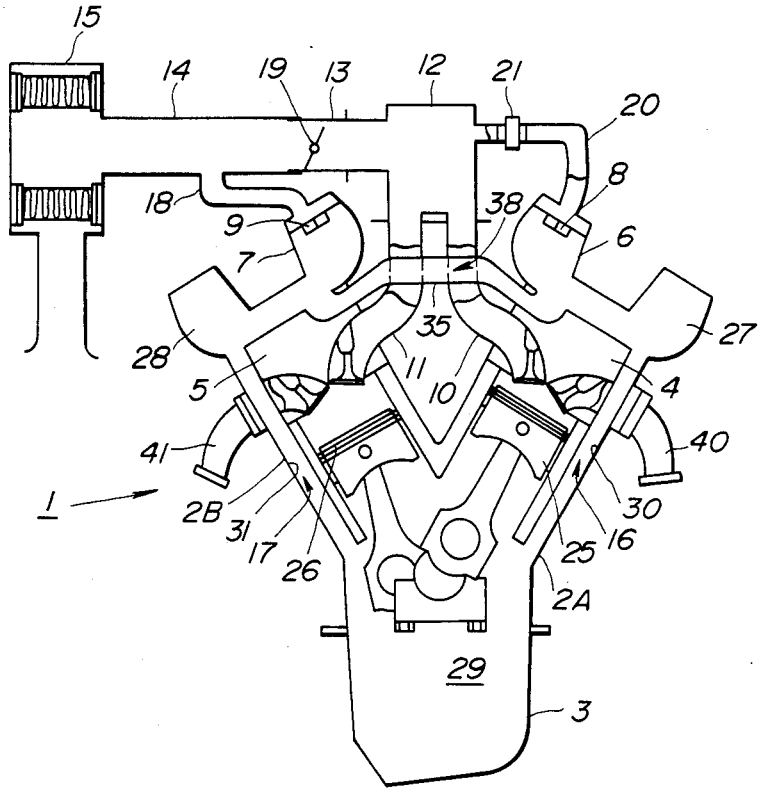
FIG. 1 is a sectional diagram of a V-type internal combustion engine and a crankcase emission control system according to an embodiment of this invention.

With reference to FIG. 1, a V-type internal combustion engine 1 includes two cylinder blocks 2A and 2B defining two banks of combustion chambers or cylinders. Pistons 25, only one of which is shown, are slidably disposed within the engine cylinders in the first cylinder block 2A. Pistons 26, only one of which is shown, are slidably disposed within the engine cylinders in the second cylinder block 2B.

A crankcase fixed to the bottoms of the cylinder blocks 2A and 2B defines a crank chamber 29 accommodating a crankshaft arrangement. A lower portion the crankcase forms an oil pan 3 defining a reservoir of engine lubricating oil.

Cylinder heads 4 and 5 are mounted atop the cylinder blocks 2A and 2B respectively. Rocker or cam covers 6 and 7 are fixed to the tops of the cylinder heads 4 and 5 respectively. The cylinder head 4 and the rocker or cam cover 6 define a chamber 27 accommodating inlet and outlet valve drive arrangements (not shown). The cylinder head 5 and the rocker or cam cover 7 define a chamber 28 accommodating inlet and outlet valve drive arrangements (not shown).

As shown in FIGS. 1–4, an intake manifold arrangement includes a first set of branches 10 connected to the cylinder head 4 and a second set of branches 11 connected to the cylinder head 5. A collecting section 12 located directly above the center between the two engine cylinder banks defines a juction of the manifold branches 10 and 11.

Figure 2:
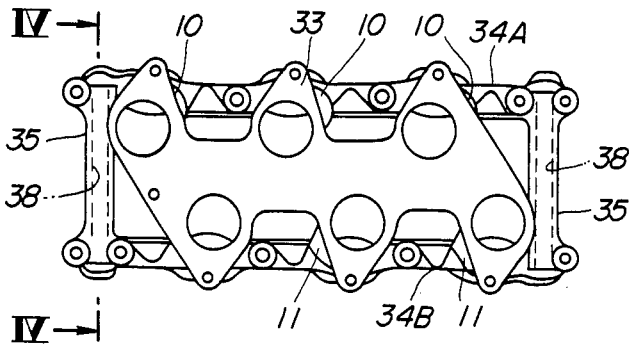
FIG. 2 is a plan view of the intake manifold arrangement of FIG. 1.
Figure 3:
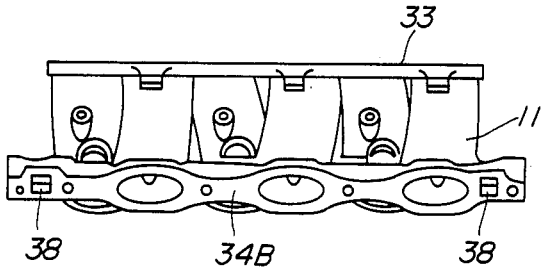
FIG. 3 is a side view of the intake manifold arrangement of FIG. 2.
Figure 4:
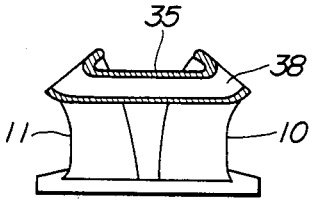
FIG. 4 is a sectional view of the intake manifold arrangement taken along lines IV—IV in FIG. 2.

As shown in FIGS. 2–4, the intake manifold arrangement includes attachment flanges 33, 34A, and 34B integral with the manifold branches 10 and 11. The manifold branches 10 extend between the flange 33 and the flange 34A. The manifold branches 11 extend between the flange 33 and the flange 34B. The flange 33 is attached to the collecting section 12. The flange 34A is attached to the cylinder head 4. The flange 34B is attached to the cylinder head 5. Two pairs of adjacent and opposing ends of the flanges 34A and 34B are connected by ribs 35 integral with the flanges 34A and 34B.

As shown in FIG. 1, a chamber 13 accommodating a throttle valve 19 is directly connected to the collecting section 12. An air intake passage 14 extends between an air cleaner 15 and the throttle chamber 13. After air passes through the cleaner 15, it enters the collecting section 12 via the air intake passage 14 and the throttle chamber 13. Then, the air is distributed by the collecting section 12 to the manifold branches 10 and 11, entering the combustion chambers.

The throttle valve 19 meters the air into the combustion chambers. A fuel supply system (not shown) injects fuel into the air at a rate dependent on the metered rate of the air supply. This controlled rate of the fuel injection into the air produces an air-fuel mixture having a preset air-fuel ratio.

A blow-by gas return passage 16 connected between the crank chamber 29 and the collecting section 12 includes a first portion 30, the cam chamber 27, and a second portion 20. The first portion 30 is defined in the cylinder block 2A and the cylinder head 4. The first portion 30 extends between the crank chamber 29 and the cam chamber 27 along one side of the cylinder block 2A and the cylinder head 4. The second portion 20 is defined by a pipe connecting the cam chamber 27 and the collecting section 12. In this way, the blow-by gas return passage 16 connects the crank chamber 29 to the segment of the air intake system downstream of the throttle valve 19.

A gas passage 17 connected between the crank chamber 29 and the air intake passage 14 includes a first portion 31, the cam chamber 28, and a second portion 18. The first portion 31 is defined in the cylinder block 2B and the cylinder head 5. The first portion 31 extends between the crank chamber 29 and the cam chamber 28 along one side of the cylinder block 2B and the cylinder head 5. The second portion 18 is defined by a pipe connecting the cam chamber 28 and the air intake passage 14. In this way, the gas passage 17 connects the crank chamber 29 to the segment of the air intake system upstream of the throttle valve 19.

An oil separation device or oil eliminator 8 is disposed in the segment of the cam chamber 27 near the connection between the cam chamber 27 and the blow-by gas return pssage 20. Another oil separation device or oil eliminator 9 is disposed in the segment of the cam chamber 28 near the connection between the cam chamber 28 and the gas passage 18.

A positive crankcase ventilation (PCV) or emission control valve 21 disposed in the blow-by gas return passage 20 adjusts the effective cross-sectional area of the passage 20 as a function of vacuum developed in the air intake passage downstream of the throttle valve 19. It should be noted that this vacuum strengthens as the load on the engine 1 decreases. Specifically, the degree of opening of the control valve 21 increases as the intake vacuum weakens, that is, as the engine load increases.

Communication passages 38 connect the cam chambers 27 and 28. As shown in FIGS. 1–4, the communication passages 38 are defined within the connecting ribs 35 of the intake manifold arrangement. In other words, the connecting ribs 35 form ducts defining the communication passages 38.

In operation, at low engine loads, the throttle valve 19 opens at small degrees so that the rate of the air-fuel mixture supply to the combustion chambers is relatively small. Accordingly, the rate of the blow-by gas emission into the cank chamber 29 is also small. At these low engine loads, a portion of air moves from the air intake passage 14 into the gas passage 18 and then enters the cam chamber 28. The air moves from the cam chamber 28 into the gas passage 31 and the communication passages 38 and then enters the crank chamber 29 and the cam chamber 27. In the crank chamber 29, the air mixes with the blow-by gas and carries it toward the blow-by gas return passage 30. The mixture of the air and the blow-by gas moves from the crank chamber 29 into the blow-by gas return passage 30, entering the cam chamer 27 and meeting the air admitted into the cam chamber 27 from the communication passages 38. The.air and the blow-by gas move from the cam chamber 27 into the blow-by gas return passage 20 via the oil eliminator 8 and then advances into the air intake passage downstream of the throttle valve 19 via the blow-by gas return passage 20 and the control valve 21. After the blow-by gas enters the air intake passage, it returns to the combustion chambers.

At these low engine loads, the intake vacuum is strong so that the control valve 21 opens at small degrees. The rate of the air flow from the air intake passage 14 into the gas passage 18 increases with the degree of opening of the control valve 21. At these low engine loads, the control valve 21 maintains the rate of the air flow from the air intake passage 14 into the gas passage 18 at values matching the small rates of the blow-by gas emission into the crank chamber 29.

At the low engine loads, an acceptably small portion of the engine lubricating oil is entrained by the air and the blow-by gas and is transported from the crank chamber 29 to the cam chamber 27. In the cam chamber 27, the air and the blow-by gas are also exposed to a spray of engine lubricating oil off the inlet and outlet valve drive trains. The oil eliminator 8 separates or removes the engine lubricating oil from the air and the blow-by gas. It should be noted that the oil eliminator 8 can not completely separate the engine lubricating oil. The separated engine lubricating oil is returned by an arrangement (not shown) to the oil reservoir defined by the oil pan 3.

At heavy engine loads, the throttle valve 19 opens widely so that the rate of the air-fuel mixture supply to the combustion chambers is relatively large. Accordingly, the rate of the blow-by gas emission into the cank chamber 29 is also large. At these heavy engine loads, the blow-by gas moves from the crank chamber 29 into both the blow-by gas return passage 30 and the gas passage 31 and then enters the cam chambers 27 and 28. The blow-by gas separates in the cam chamber 27 into two streams, one moving from the cam chamber 27 into the blow-by gas return passage 20 via the oil eliminator 8 and the other moving from the cam chamber 27 into the communication passages 38. After the blow-by gas passes through the blow-by gas return passage 20 and the control valve 21, it enters the air intake passage downstream of the throttle valve 19 and then returns to the combustion chambers. After the blow-by gas passes through the communication passages 38, it enters the cam chamber 28 and meets the blow-by gas admitted into the cam chamber 28 from the gas passage 31. The blow-by gas moves from the cam chamber 28 into the gas passage 18 via the oil eliminator 9 and then enters the air intake passage 14 upstream of the throttle valve 19. After the blow-by gas enters the air intake passage 14, it returns to the combustion chambers.

At these heavy engine loads, a portion of the engine lubricating oil is entrained by the two blow-by gas flows and is transported from the crank chamber 29 to the cam chambers 27 and 28. The rate of this unwanted transportation of the engine lubricating oil from the crank chamber 29 increases with the speeds of the blow-by gas flows moving out of the crank chamber 29. The communication passages 38 increase the sum of the effective cross-sectional areas of the passages conducting the blow-by gas from the crank chamber 29 to the air intake system, so that the speeds of the blow-by gas flows are limited to values at which the rates of the unwanted transportation of the engine lubricating oil are acceptable. Since the rate of the dissipation of the engine lubricating oil decreases with the rate of the transportation of the engine lubricating oil from the crank chamber 29 to the air intake system, these acceptable rates of the transportation of the engine lubricating oil enable admissable rates of the dissipation of the engine lubricating oil.

At the heavy engine loads, the blow-by gas flows carry a small portion of the engine lubricating oil from the crank chamber 29 to the cam chamber 28. In the cam chamber 28, the blow-by gas is also exposed to a spray of engine lubricating oil off the inlet and outlet valve drive trains. The oil eliminator 9 separates or removes the engine lubricating oil from the blow-by gas. It should be noted that the oil eliminator 9 can not completely separate the engine lubricating oil. The separated engine lubricating oil is returned by an arrangement (not shown) to the oil reservoir defined by the oil pan 3.

At the heavy engine loads, the intake vacuum is weak so that the control valve 21 opens widely. Accordingly, the control valve 21 allows the blow-by gas to flow through the blow-by gas return passage 20 at or near its maximal rate. In general, the opening of the control valve 21 at its fully unblocked condition is limited to a moderate value for the following reason. If the maximal value of the opening of the control valve 21 is relatively high, appropriate control of the flow of the air and the blow-by gas is difficult at low engine loads. Therefore, even at the heavy engine loads, the effective cross-sectional area of the blow-by gas return passage 20 is limited to moderate values. The communication passages 38 compensate for this limitation on the effective cross-sectional area of the blow-by gas return passage 20 and thus maintain a relatively large effective cross-sectional area of the passages conducting the blow-by gas from the crank chamber 29 to the air intake system, so that the speeds of the total blow-by gas flows moving from the crank chamber 29 to the air intake system are limited to acceptable values.

It should be noted that this invention is particularly effective to engines in which gas passages 16 and 17 have limited and small cross-sectional areas, e.g., engines having cam drive trains including a timing belt.

What is claimed is:

1. A crankcase emission control system for a V-type internal combustion engine having first and second cylinder blocks, combustion chambers defined by the first and second cylinder blocks, an air intake passage leading to the combustion chambers, a throttle valve disposed in the air intake passage, first and second cylinder heads mounted on the first and second cylinder blocks respectively, first and second cam covers mounted on the first and second cylinder heads respectively, a first cam chamber defined by the first cylinder head and the first cam cover, a second cam chamber defined by the second cylinder head and the second cam cover, and a crank chamber, the system comprising:

(a) a first gas passage connecting the crank chamber to a point of the air intake passage downstream of the throttle valve via the first cam chamber;

(b) a second gas passage connecting the crank chamber to a point of the air intake passage upstream of the throttle valve via the second cam chamber;

(c) a control valve disposed in a segment of the first gas passage between the first cam chamber and the air intake passage, the control valve being responsive to a vacuum developed in the air intake passage downstream of the throttle valve; and (d) a communication passage connecting the first and second cam chambers.

2. The system of claim 1, wherein the communication passage is defined by a duct integral with an air intake manifold.

3. The system of claim 1, wherein the engine has a collecting section defining a segment of the air intake passage, an intake manifold arrangement including a first flange attached to the collecting section, a second flange attached to the first cylinder head, a third flange attached to the second cylinder head, a first set of manifold branches extending between the first flange and the second flange, and a second set of manifold branches extending between the first flange and the third flange, and wherein the communication passage is defined within a rib connecting the second flange and the third flange.

4. The system of claim 3, wherein the first flange, the second flange, the third flange, the first set of the manifold branches, the second set of the manifold branches, and the rib are all integral with each other.

5. The system of claim 3, wherein the rib comprises first and second sub-ribs, the first sub-rib connecting a first pair of adjacend and opposing ends of the second and third flanges, the second sub-rib connecting a second pair of adjacent and opposing ends of the second flange and the third flange, and wherein the communication passage comprises first and second sub-passages defined within the first and second sub-ribs respectively.

6. A crankcase emission control system for an engine having an air intake passage leading to a combustion chamber, a throttle valve disposed in the air intake passage, and a crank chamber, the system comprising:

(a) a first gas passage connecting the crank chamber to a point of the air intake passage downstream of the throttle valve;

(b) a control valve disposed in the first gas passage;

(c) a second gas passage connecting the crank chamber to a point of the air intake passage upstream of the throttle valve; and (d) a communication passage connecting the second gas passage to a point of the first gas passage between the control valve and the crank chamber.

* * * * *